US006628800B2

(12) United States Patent
Tajima

(10) Patent No.: US 6,628,800 B2
(45) Date of Patent: Sep. 30, 2003

(54) ELECTROACOUSTIC TRANSDUCER AND METHOD FOR MANUFACTURING THE SAME

(75) Inventor: Kazushige Tajima, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 235 days.

(21) Appl. No.: 09/742,129

(22) Filed: Dec. 22, 2000

(65) Prior Publication Data

US 2001/0006488 A1 Jul. 5, 2001

(30) Foreign Application Priority Data

Dec. 24, 1999 (JP) ..... P. 11-368032

(51) Int. Cl.[7] ..... H04R 25/00

(52) U.S. Cl. ..... 381/417; 381/396; 381/412; 381/418; 381/431

(58) Field of Search ..... 367/14, 175; 381/150, 381/152, 396, 398, 412, 414, 417, 418, 419, 431

(56) References Cited

U.S. PATENT DOCUMENTS 5,394,479 A * 2/1995 Ishigaya et al. ..... 381/396
5,416,751 A * 5/1995 Imahori et al. ..... 381/398
6,023,519 A * 2/2000 Tajima et al. ..... 381/412
6,233,346 B1 * 5/2001 Asshina ..... 381/412

FOREIGN PATENT DOCUMENTS

| | | |
|---|---|---|
| GB | 2014017 A | 8/1979 |
| JP | 2-268598 | 2/1990 |
| JP | 5-49082 | 2/1993 |

OTHER PUBLICATIONS

Patent Abstracts of Japan, vol. 015, No. 022, Jan. 18, 1991.
Patent Abstracts of Japan, vol. 017, No. 351, Jul. 2, 1993.

* cited by examiner

*Primary Examiner*—Curtis Kuntz
*Assistant Examiner*—Suhan Ni
(74) *Attorney, Agent, or Firm*—Sughrue Mion, PLLC

(57) ABSTRACT

An electroacoustic transducer 1 is constituted by a base 24 formed of magnetic material; a magnetic core 22 formed of magnetic material and provided erectly on the base 24; a diaphragm 20 formed of magnetic material and supported with an air gap between the diaphragm and a forward end of the magnetic core; a magnet 25 constituting a magnetic circuit together with the base 24, the magnetic core 22 and the diaphragm 20 so as to provide a magnetostatic field; a coil 23 disposed around the magnetic core 22 for applying an oscillating magnetic field to the magnetic circuit; a housing 30 molded integrally with the base 24 and the magnet 25, and so on. The housing 30 has notch holes 38 extending from a bottom surface thereof to the magnet 25.

3 Claims, 3 Drawing Sheets

ELECTROACOUSTIC TRANSDUCER AND METHOD FOR MANUFACTURING THE SAME

BACKGROUND OF THE INVENTION

1. Field of the Invention

The present invention relates to an electroacoustic transducer for generating sound by electromagnetic acoustic conversion, and a method for manufacturing such an electroacoustic transducer.

2. Description of the Related Art

An electroacoustic transducer has a magnetic circuit in which a magnetic field from a magnet passes through a base member, a magnetic core and a diaphragm and returns the magnet again. When an electric oscillating signal is supplied to a coil wound around the magnetic core, an oscillating magnetic field generated by the coil is superimposed on the magnetostatic field of the magnetic circuit so that oscillation generated in the diaphragm is transmitted to the air. Thus, sound is generated.

Various properties of the electroacoustic transducer, for example, the sound pressure level, the frequency characteristic, the conversion efficiency, etc. vary complicatedly in accordance with the materials, the parts dimensions, the assembly accuracy of the base member, the magnetic core, the diaphragm, the magnet, and so on. Particularly, the dimensional variation of an air gap between a forward end of the magnetic core and the diaphragm has a large influence on the distribution of a magnetic field acting on the diaphragm. Therefore, severe accuracy control is required for the air gap.

SUMMARY OF THE INVENTION

It is an object of the present invention to provide an electroacoustic transducer in which the positional accuracy of members can be improved on a large scale and stable properties can be obtained, and to provide a method for manufacturing such an electroacoustic transducer.

According to the present invention, there is provided an electroacoustic transducer comprising: a plate-like base member formed of magnetic material; a magnetic core formed of magnetic material and provided erectly on the base member; a diaphragm formed of magnetic material and supported with an air gap between the diaphragm and a forward end of the magnetic core; a magnet constituting a magnetic circuit together with the base member, the magnetic core and the diaphragm so as to provide a magnetostatic field; a coil disposed around the magnetic core for applying an oscillating magnetic field to the magnetic circuit; and a housing member molded integrally with the base member and the magnet, the housing member having a notch portion extending from a bottom surface thereof to the magnet.

According to the present invention, because the housing member has a notch portion extending from a bottom surface thereof to the magnet, the magnet is exposed through the notch portion so that access to the magnet can be made from the outside. Accordingly, quality control such as positioning or position-measuring of the magnet, or the like, can be carried out in a step of assembling or inspecting the electroacoustic transducer. Thus, it is possible to realize an electroacoustic transducer having stable properties.

In addition, the present invention has a feature that the notch portion is filled with a filler.

According to the present invention, though there is no problem in operation even if the notch portion of the housing member is left as it is, air tightness, durability, and so on, of products can be enhanced by filling the notch portion with a filer of synthetic resin or the like.

In addition, the present invention has a feature that a pedestal for supporting the diaphragm is formed on the housing member.

According to the present invention, because the attachment accuracy of the diaphragm to the housing member is improved by forming the pedestal to support the diaphragm on the housing member, the size of the air gap between the diaphragm and the forward end of the magnetic core can be kept with high accuracy.

Further, according to the present invention, there is provided a method for manufacturing an electroacoustic transducer, wherein the transducer comprises: a plate-like base member formed of magnetic material; a magnetic core formed of magnetic material and provided erectly on the base member; a diaphragm formed of magnetic material and supported with an air gap between the diaphragm and a forward end of the magnetic core; a magnet constituting a magnetic circuit together with the base member, the magnetic core and the diaphragm so as to provide a magnetostatic field; a coil disposed around the magnetic core for applying an oscillating magnetic field to the magnetic circuit; and a housing member molded integrally with the base member and the magnet; and wherein the method for manufacturing the electroacoustic transducer comprises the steps of: inserting the base member and the magnet into a mold; and injecting synthetic resin into the mold in a condition that a pressing pin provided in the mold presses the magnet from the base member side to thereby insert-mold the housing member.

According to the present invention, in the case where the housing member is insert-molded together with the base member and the magnet, a pressing pin for positioning the magnet is provided in a mold, and synthetic resin is injected in a condition that the pressing pin presses the magnet from the base member side. Accordingly, when the synthetic resin flows into a gap between the base member and the magnet, the magnet can be prevented from floating or shifting in position. Thus, an adequate quantity of synthetic resin can be poured into this gap. In addition, because an adequate quantity of synthetic resin enters the gap, the resin injection pressure distribution or the stress distribution at the time of resin solidification becomes uniform all over the resin. Thus, it is possible to prevent the base member from being deformed due to uneven pressure, so that it is possible to improve the positional accuracy of the members constituting the magnetic circuit on a large scale. Particularly, it is possible to keep the size of the air gap between the forward end of the magnetic core and the diaphragm with high precision.

In addition, it is preferable that the pressing pin is removably attached to the mold so that the pressing pin can be replaced with another pressing pin having a different regulating position even if the thickness of the magnet is changed in accordance with product specifications.

In addition, the present invention has a feature that the method further comprises the step of filling a notch portion of the housing member formed by the pressing pin with a filler.

According to the present invention, though there is no problem in operation even if the notch portion of the housing member is left as it is, air tightness, durability, and so on, of products can be enhanced by filling the notch portion with a filer of synthetic resin or the like.

BRIEF DESCRIPTION OF THE DRAWINGS

FIGS. 5A to 5F are sectional views showing a step of insert-molding the housing 30, in which FIGS. 5A to 5C show a comparative example, and FIGS. 5D to 5F show an embodiment of the present invention.

DETAILED DESCRIPTION OF THE PREFERRED EMBODIMENTS

Figure 1:
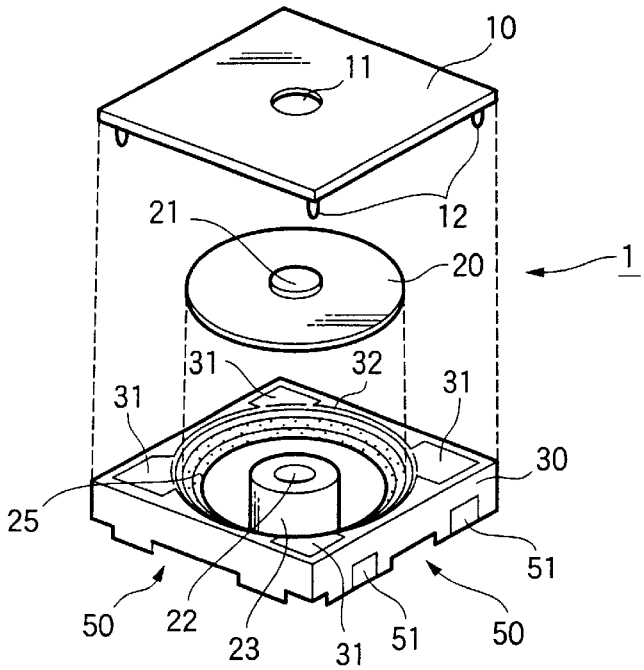
FIG. 1 is an exploded perspective view showing an embodiment of the present invention.

FIG. 1 is an exploded perspective view showing an embodiment of the present invention. In an electroacoustic transducer 1, a top plate 10 having a sound release hole 11 is fixed on a compressed square tubular box-like housing 30. The electroacoustic transducer 1 has dimensions of a width of 7.5 mm, a depth of 7.5 mm and a height of 3 mm by way of example.

A columnar magnetic core 22 is provided erectly at the center of the housing 30. A coil 23 is wound around the magnetic core 22. An annular magnet 25 is partially buried in the inner wall of the housing 30. The magnet 25 is disposed coaxially with the magnetic core 22. An annular internal space is ensured between the magnet 25 and the coil 23.

An annular step is formed in the upper surface of the inner wall of the housing 30. A disc-like diaphragm 20 is mounted on a horizontal pedestal 32 and positioned by the annular step.

Recess portions 31 are formed in upper surface corner portions of the housing 30 respectively, and four protrusions 12 are formed in lower surface corner portions of the top plate 10 respectively. The position where the top plate 10 is attached to the housing 30 is regulated by the respective engagements between the inner corners of the recess portions 31 and the protrusions 12.

In the lower portion of the outer wall of the housing 30, four terminals 51 for being electrically connected with a circuit board by soldering or the like are provided, and communication grooves 50 are further formed to make the internal space of the housing 30 communicate with the outside air. The housing 30 and the top plate 10 are formed of synthetic resin such as thermoplastic resin or the like.

Figure 2:
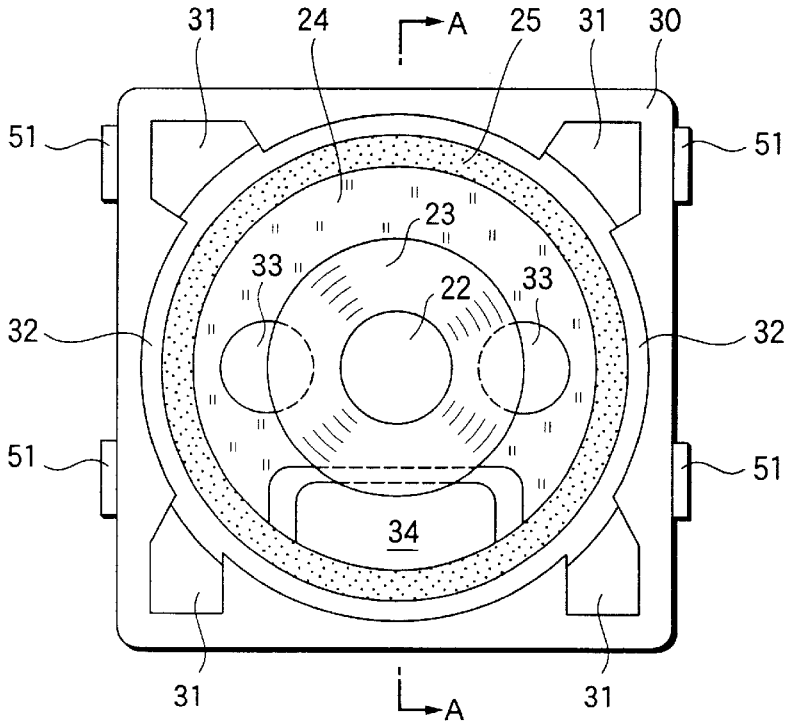
FIG. 2 is a plan view of a housing 30 in FIG. 1, viewed from its top.
Figure 3:
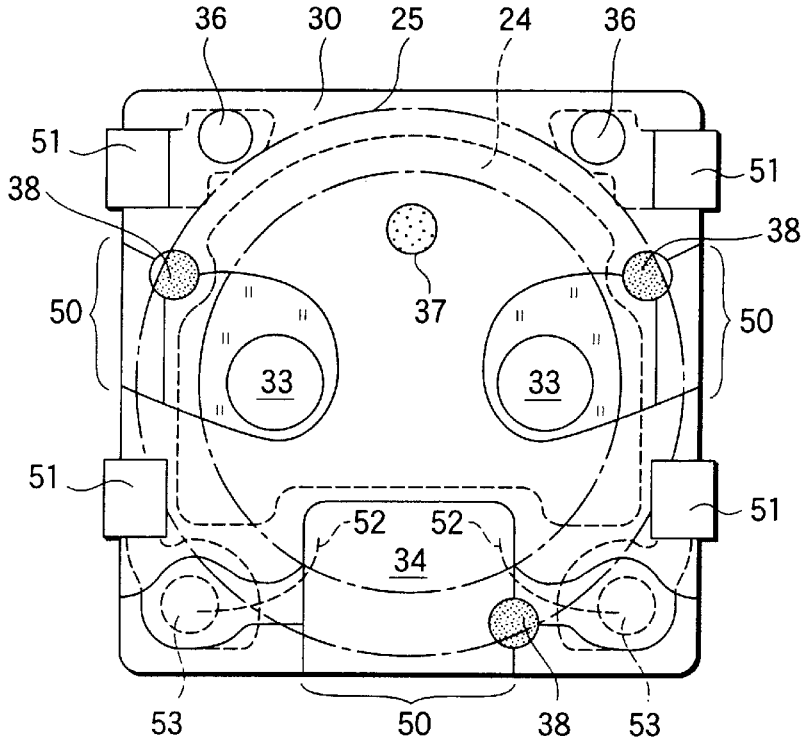
FIG. 3 is a bottom view of the housing 30 in FIG. 1, viewed from its bottom.
Figure 4:
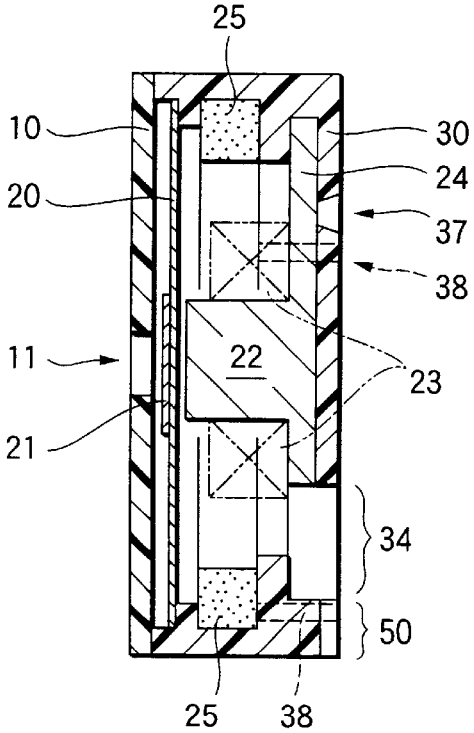
FIG. 4 is a sectional view of an electroacoustic transducer 1, taken on line A—A in FIG. 2.

FIG. 2 is a plan view of the housing 30 in FIG. 1, viewed from its top. FIG. 3 is a bottom view of the housing 30 in FIG. 1, viewed from its bottom. FIG. 4 is a sectional view of the electroacoustic transducer 1, taken on line A—A in FIG. 2.

First, referring to FIG. 2, the annular pedestal 32 for supporting the diaphragm 20 is formed in a position which is a little lower than the top surface of the housing 30, and the top surface of the annular magnet 25 is situated in a position which is lower than the pedestal 32. The coil 23 is disposed around the magnetic core 22 at the housing center. A plate-like base 24 is disposed under the magnetic core 22, the coil 23 and the magnet 25, and the circumferential edge portion of the base 24 is partially buried in the inner wall of the housing 30. Near the outer circumference of the coil 23, communication holes 33 and 34 for making the annular internal space of the housing 30 communicate with the external environment are formed in the bottom plate portion of the housing 30 and the base 24 respectively.

Next, referring to FIG. 3, in a position which is a little lower than the bottom surface of the housing 30, the three communication grooves 50 are formed to surround the communication holes 33 and 34. The communication grooves 50 extend to the lower portion of the outer wall of the housing 30 so that the annular internal space of the housing 30 communicates with the external environment. The base 24 is partially exposed around the communication holes 33.

In addition, in the housing bottom surface, a notch hole 37 is formed in a position different from the positions of the communication holes 33, so that the base 24 is partially exposed also through the notch hole 37.

The terminals 51 are partially buried in the bottom surface corner portions of the housing 30 respectively, and the buried portions of the upper two of the terminals 51 are partially exposed through notch portions 36 respectively. The lower two of the terminals 51 are buried halfway in the housing 30 and exposed again near the communication hole 34. Lead wires 52 of the coil 23 are led out to the outside through the communication hole 34, and are electrically connected with the exposed portions of the lower two terminals 51 by solders 53. Thus, the lower two terminals 51 are terminals for supplying a driving signal to the coil 23, and the upper two terminals 51 are reinforcement terminals.

Further in the housing bottom surface, three notch holes 38 are formed to divide the circumference of the magnet 25 into three equal parts, and the bottom surface of the magnet 25 is partially exposed through the notch holes 38. The shape of the base 24 viewed from its top and bottom surfaces is determined to make the overlapping area with the bottom surface of the magnet 25 as large as possible from the point of view of magnetic efficiency, and to avoid the terminals 51, the notch holes 38 and the communication hole 34.

Next, referring to FIG. 4, the base 24 formed of magnetic material is buried in the internal bottom surface of the housing 30, and the magnetic core 22 formed of magnetic material is provided erectly on the base 24. Incidentally, the magnetic core 22 and the base 24 may be formed integrally as a single pole piece member.

The diaphragm 20 formed of magnetic material is supported by the upper surface of the inner wall of the housing 30 at the circumferential edge portion of the diaphragm 20. A constant air gap is ensured between the bottom surface center of the diaphragm 20 and the forward end of the magnetic core 22. A disc-like magnetic piece 21 is fixed to the top surface center of the diaphragm 20 so as to increase the mass of the diaphragm 20. Thus, the oscillation efficiency of the air is improved.

The magnet 25 is buried in the inner wall of the housing 30 so as to be disposed at a fixed distance from the circumferential edge portion of the base 24. In the case where the magnet 25 is magnetized in its thickness direction, for example, the bottom and top surfaces of the magnet 25 are magnetized into N and S poles respectively, magnetic flux from the bottom surface of the magnet 25 passes through the circumferential edge portion of the base 24, the center portion of the base 24, the magnetic core 22, the center portion of the diaphragm 20, the circumferential edge portion of the diaphragm 20 and the top surface of the magnetic 25, so as to constitute a closed magnetic circuit as a whole. The magnet 25 has a function of applying a magnetostatic field to such a magnetic circuit. The diaphragm 20 is supported stably by this magnetostatic field in a condition that the diaphragm 20 is attracted toward the magnetic core 22 and the magnet 25.

When an electric oscillating signal is supplied from the circuit board to the coil 23 wound around the magnetic core 22 through the lower two terminals 51 and the lead wires 52, the coil 23 applies an oscillating magnetic field to the magnetic circuit. Thus, the diaphragm 20 oscillates due to the superimposing of the oscillating magnetic field on the magnetostatic field so as to oscillate the air on the top and bottom surface sides of the diaphragm 20.

The top surface side of the diaphragm 20 forms a resonance chamber together with the top plate 10. When the oscillation frequency of the diaphragm 20 substantially coincides with the resonance frequency of the resonance chamber, sound generated at a high sound pressure level is released to the external environment through the sound release hole 11.

Sound generated on the bottom surface side of the diaphragm 20 has a phase opposite to that of the sound generated on the top surface side. It is therefore necessary to restrain the interference with the top-surface-side sound to the utmost. Therefore, the sound on the bottom surface side of the diaphragm 20 is released from the bottom surface of the housing 30 to the external environment through the annular internal space of the housing 30, the communication holes 33 and 34 and the communication grooves 50.

Figure 5A:
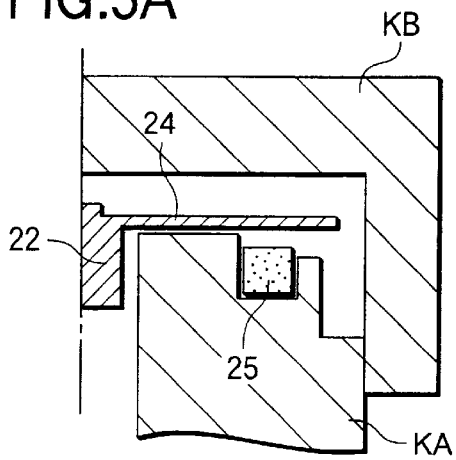
Figure 5D:
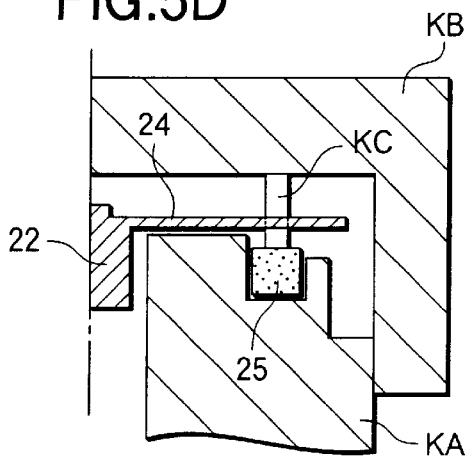
Figure 5B:
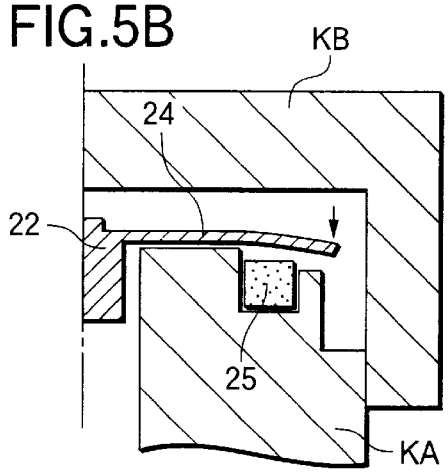
Figure 5E:
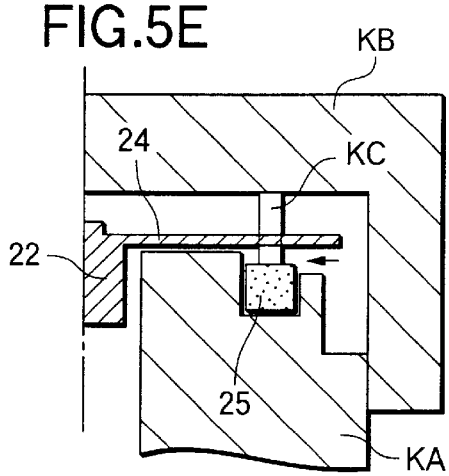
Figure 5C:
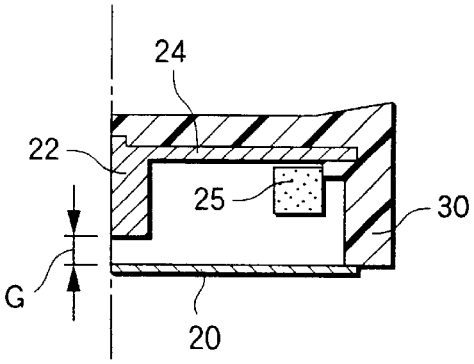
Figure 5F:
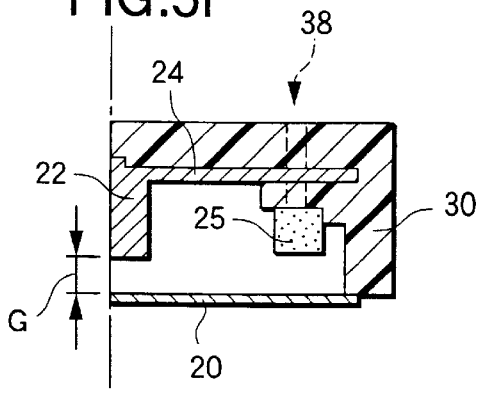

FIGS. 5A to 5F are sectional views showing a process for insert-molding the housing 30. FIGS. 5A to 5C show a comparative example, and FIGS. 5D to 5F show an embodiment of the present invention. First, referring to FIG. 5A, the molding surface of a mold KA is modeled on the shape of the top surface and the inner wall of the housing 30, and the molding surface of a mold KB is modeled on the shape of the outer wall of the housing 30. The space between the molds KA and KB corresponds to the shape of the housing 30.

The molding surface of the mold KA is formed into a shape which can position the magnetic core 22 and the base 24 and then position the not-yet-magnetized magnet 25. The gap between the not-yet-magnetized magnet 25 and the base 24 is set to be about 0 to 0.08 mm to be very narrow. In the case where the not-yet-magnetized magnet 25 is formed of sintered material such as ferrite or the like, there is a tendency that considerable variation is produced in thickness of the magnet 25. As a result, if the thickness of the magnet 25 is insufficient, the gap between the magnet 25 and the base 24 becomes large. On the contrary, if the thickness of the magnet 25 is excessive, the magnet 25 pushes up the base 24 so that magnet cracking or base deformation is produced at the time of molding.

Next, referring to FIG. 5B, when synthetic resin is injected into the mold space, the resin hardly flows into the gap between the not-yet-magnetized magnet 25 and the base 24 due to the viscosity of the resin. In addition, due to the presence of this gap, the base 24 is deformed correspondingly to the gap when the base 24 is pushed toward the magnet 25 by the resin injection pressure. Thus, the resin is solidified in this state.

After the resin is solidified, the molds are removed. The electroacoustic transducer 1 is completed through a step of magnetizing the magnet 25, a step of handling the coil lead wires 52, a step of mounting the diaphragm 20, a step of attaching the top plate 10, and so on. After these steps, when the electroacoustic transducer 1 is mounted on a circuit board by solder reflowing or the like, the destressing of the base 24 caused by reflow soldering at the time of soldering results in so-called spring-back generating. Then, as shown in FIG. 5C, the outer circumferential portion of the housing 30 is warped on the bottom surface side, and the pedestal 32 supporting the diaphragm 20 is also displaced on the bottom surface side. As a result, an air gap G between the diaphragm 20 and the magnetic core 22 becomes narrower than the aimed value thereof, so that the properties of the electroacoustic transducer 1 vary widely. The quantity of this spring-back mainly and largely depends on the variation of the magnet thickness.

As measures against such spring-back, as shown in FIG. 5D, a pressing pin KC is provided in the mold KB so as to press the not-yet-magnetized magnet 25 from the base 24 side toward the mold KA. Further, the gap between the not-yet-magnetized magnet 25 and the base 24 is set to be about 0.4 mm to be comparatively wide enough for resin to flow therein easily.

Next, referring to FIG. 5E, when synthetic resin is injected into the mold space in this state, an adequate quantity of synthetic resin flows also into the gap between the not-yet-magnetized magnet 25 and the base 24. Accordingly, the resin injection pressure is applied to both the opposite surfaces of the base 24 equally so that the base 24 can be prevented from being deformed. Further, because the not-yet-magnetized magnet 25 is positioned by the pressing pin KC, the not-yet-magnetized magnet 25 can be prevented from floating or shifting in position.

Thereafter, the molds are removed after the resin has been solidified. The electroacoustic transducer 1 shown in FIG. 5F is completed through a step of magnetizing the magnet 25, a step of handling the coil lead wires 52, a step of mounting the diaphragm 20, a step of attaching the top plate 10, and so on. As a result, the residual stress of the base 24 is substantially zero even if the base 24 is heated by reflow soldering or the like, so that no spring back is generated and the air gap G between the diaphragm 20 and the magnetic core 22 coincides with the aimed value thereof. Thus, the positional accuracy of members such as the magnet 25, the base 24, and so on, can be improved on a large scale, so that the properties of products can be stabilized.

In addition, even if the magnet thickness varies, the gap between the not-yet-magnetized magnet 25 and the base 24 is so wide that the variation of the magnet thickness does not give a large influence. On the other hand, it is preferable that the pressing pin KC is removably attached to the mold so that the pressing pin KC can be replaced with another pressing pin having a different regulating position even if the magnet thickness is changed in accordance with product specifications.

A cavity created by the pressing pin KC becomes the notch hole 38 as shown in FIGS. 3 and 4. In addition, pressing pins for positioning the base 24 and the upper two terminals 51 may be provided in the mold in the step of insert-molding the housing 30. Cavities created by these pressing pins become the notch holes 36 and 37.

The magnet 25, the base 24 and the terminals 51 are partially exposed through the notch holes 36 to 38 formed thus. Accordingly, there is an advantage that quality control such as positioning or position measuring of the members, or the like, is facilitated in the step of assembling or inspecting the electroacoustic transducer.

Although there is no problem in operation even if the notch holes 36 to 38 are left as they are, air tightness, durability, and so on, of products can be enhanced by an additional step of filling the notch holes 36 and 38 with a filer of synthetic resin or the like (preferably the same material as that of the housing 30).

Incidentally, although the above description showed an example in which a not-yet-magnetized magnet was used as a magnet to be inserted when a housing was molded, a magnetized magnet may be used if a mold made of non-magnetic material such as aluminum or the like is used.

As has been described above in detail, according to the present invention, a notch portion is formed in a housing member so as to range from its bottom surface to a magnet. Thus, the magnet is exposed through the notch portion. As a result, quality control such as positioning or position measuring of the magnet, or the like, can be carried out in a step of assembling or inspecting the electroacoustic transducer. Thus, it is possible to realize an electroacoustic transducer having stable properties.

In addition, if the notch portion is filled with a filler of synthetic resin or the like, air tightness, durability, and so on, of products can be enhanced.

Further, according to the present invention, in the case where the housing member is insert-molded, synthetic resin is injected in a condition that a pressing pin provided in a mold presses a magnet from the base member side. Accordingly, the magnet can be prevented from floating or shifting in position, and the positional accuracy of the magnet can be improved on a large scale.

What is claimed is:

1. An electroacoustic transducer comprising:

a plate-like base member m de of magnetic material;

a magnetic core made of magnetic material and provided erectly on said base member;

a diaphragm made of magnetic material and supported with an air gap between said diaphragm and a forward end of said magnetic core;

a magnet constituting a magnetic circuit together with said base member, said magnetic core and said diaphragm so as to provide a magnetostatic field;

a coil disposed around said magnetic core for applying an oscillating magnetic field to said magnetic circuit; and a housing member molded integrally with said base member and said magnet, said housing member having a notch portion extending from a bottom surface thereof to said magnet, wherein said base member is so set as to avoid the notch portion, a gap is formed between said base member and said magnet, and resin is disposed in said gap.

2. An electroacoustic transducer according to claim 1, wherein said notch portion is filled with a filler.

3. An electroacoustic transducer according to claim 1, wherein a pedestal for supporting said diaphragm is formed on said housing member.

* * * * *